US006863388B2

(12) United States Patent
Seino et al.

(10) Patent No.: US 6,863,388 B2
(45) Date of Patent: Mar. 8, 2005

(54) INK CARTRIDGE AND INK JET RECORDING HEAD ADAPTABLE FOR THE SAME

(75) Inventors: Takeo Seino, Nagano (JP); Yoshihiro Koizumi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/024,262

(22) Filed: Dec. 21, 2001

(65) Prior Publication Data

US 2002/0118262 A1 Aug. 29, 2002

(30) Foreign Application Priority Data

Dec. 25, 2000 (JP) ..... P2000-392936
Jan. 25, 2001 (JP) ..... P2001-016900
Dec. 18, 2001 (JP) ..... P2001-384819

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 4,514,742 A * 4/1985 Suga et al. ..... 347/85
5,365,260 A * 11/1994 Kitani et al. ..... 347/87
5,805,187 A 9/1998 Sasaki
5,949,459 A 9/1999 Lewis et al.
6,086,193 A * 7/2000 Shimada et al. ..... 347/86
6,179,416 B1 * 1/2001 Ikeda et al. ..... 347/86

FOREIGN PATENT DOCUMENTS

| | | | |
|---|---|---|---|
| CN | 1252758 | A | 5/2000 |
| EP | 0 496 642 | A2 | 7/1992 |
| EP | 0 519 457 | A2 | 12/1992 |
| EP | 0 756 936 | A2 | 12/1992 |
| EP | 0 864 428 | A2 | 9/1998 |
| JP | 7-68770 | A | 3/1995 |
| JP | 9-207349 | A | 8/1997 |
| WO | WO 98/55320 | | 12/1998 |

OTHER PUBLICATIONS

Japanese Abstract No. 01118442, Feb. 10, 1989, NEC Home Electron Ltd.
Japanese Abstract No. 11129492, May 18, 1999, Seiko Epson Corp.

* cited by examiner

*Primary Examiner*—Anh T. N. Vo
(74) *Attorney, Agent, or Firm*—Sughrue Mion, PLLC

(57) ABSTRACT

An ink cartridge includes ink passages (5) which are spaced from a bottom part (2*a*) of a container by a fixed distance and extend parallel to the bottom part (2*a*) while being disposed within an area of the bottom part (2*a*), ink supply ports (7) having an opening surface at the ends of the ink passages (5), which the opening surface may be connected to ink guide members (38) communicating with an ink jet recording head (37) and directed perpendicular to the bottom part (2*a*). In the ink cartridge, the bottom part (2*a*) of the container is guided by a protrusion (39) of the carriage (33).

12 Claims, 10 Drawing Sheets

INK CARTRIDGE AND INK JET RECORDING HEAD ADAPTABLE FOR THE SAME

BACKGROUND OF THE INVENTION

The present invention relates to an ink jet recording apparatus of the type in which ink is supplied from a detachably attached, ink container to a recording head, and ink drops are ejected from the recording head onto a recording medium to record information thereon, and an ink cartridge adaptable for the ink jet recording apparatus.

In the ink cartridge used for the recording apparatus in which ink contained in the ink cartridge attached to the carriage is supplied from the ink supply section to the ink jet recording head, the atmosphere communicating part and the ink supply section are both sealed with sealing members, whereby a required degassed rate is guaranteed before the ink cartridge is used (see Japanese Patent Laid-Open No. 9-207349). In use, the sealing member applied to the atmosphere communicating part is opened with a pin or the like, and the ink supply section is connected to the recording head by use of a joint pin or the like.

With the downsizing tendency of the computer, the following market need emerges: the ink jet recording apparatus is thinned in size, and the recording apparatus and other devices, e.g., a scanner and a computer, are stacked one on another in use.

To satisfy such a need, it is desirable that the ink cartridge may be loaded into the recording apparatus from the front side, viz., it may be front-loaded into the recording apparatus.

In front-loading the ink cartridge, the ink cartridge may be attached to and detached from the recording apparatus by turning the ink cartridge 90° and horizontally moving the ink supply ports of the cartridge. In this case, the cartridge is put in the upright standing state and hence, the attaching/detaching operation is instable. Additionally, the surface of the ink cartridge which is opposed to the ink supply ports, viz., the atmosphere opening formed in the lid, is exposed to the ink contained. In this condition, ink leakage will probably occur when ambient temperature varies.

To cope with this, there is proposed an ink cartridge. In the cartridge, an ink supply port is formed in the side wall of the ink container, and the cartridge is attached to and detached from the recording apparatus by horizontally moving the cartridge, as disclosed in Japanese Patent Laid-Open No. 7-68770.

In the proposed cartridge, the ink flow passage interconnecting the ink container and the recording head is long, so that the area or volume of the carriage is large.

SUMMARY OF THE INVENTION

Accordingly, an object of the present invention is to provide an ink cartridge which may be front loaded without any size increase of the carriage.

Another object of the present invention is to provide an ink jet recording apparatus which is adaptable for the ink cartridge.

To achieve the above object, there is provided an ink cartridge having at least one ink supply port for supplying ink, which is provided on a bottom part of a container including at least one ink chamber, and communicates with an ink jet recording head of a recording apparatus. The ink cartridge includes an ink supply passage which, preferably, is spaced from a bottom part of the container by a fixed distance and extends parallel to the bottom part while being disposed within an area of the bottom part. The ink supply port has an opening surface at the end of the ink supply passage, and the opening surface may be connected to an ink guide member communicating with the ink jet recording head. The opening surface is directed perpendicular to the bottom part. An area of the lower surface of the bottom part is guided by a protrusion formed on the recording apparatus when the ink supply port is inserted into the ink guide member.

Thus, the ink supply port of the ink cartridge is formed such that the ink supply passage extend parallel to the bottom surface of the ink cartridge. With this feature, the ink passage ranging to the recording head is reduced, so that the increase of the area or volume of the carriage is suppressed. Since the vicinity of the ink passage is guided by the protrusion of the recording apparatus, the ink passage can be reliably connected to the ink guide member.

The present disclosure relates to the subject matter contained in Japanese patent application Nos.

2000-392936 (filed on Dec. 25, 2000), 2001-016900 (filed on Jan. 25, 2001) and 2001-384819 (filed on Dec. 18, 2001), which are expressly incorporated herein by reference in their entireties.

DESCRIPTION OF THE PREFERRED EMBODIMENT

The preferred embodiments of the present invention will be described in detail with reference to the accompanying drawings.

Figure 1A:
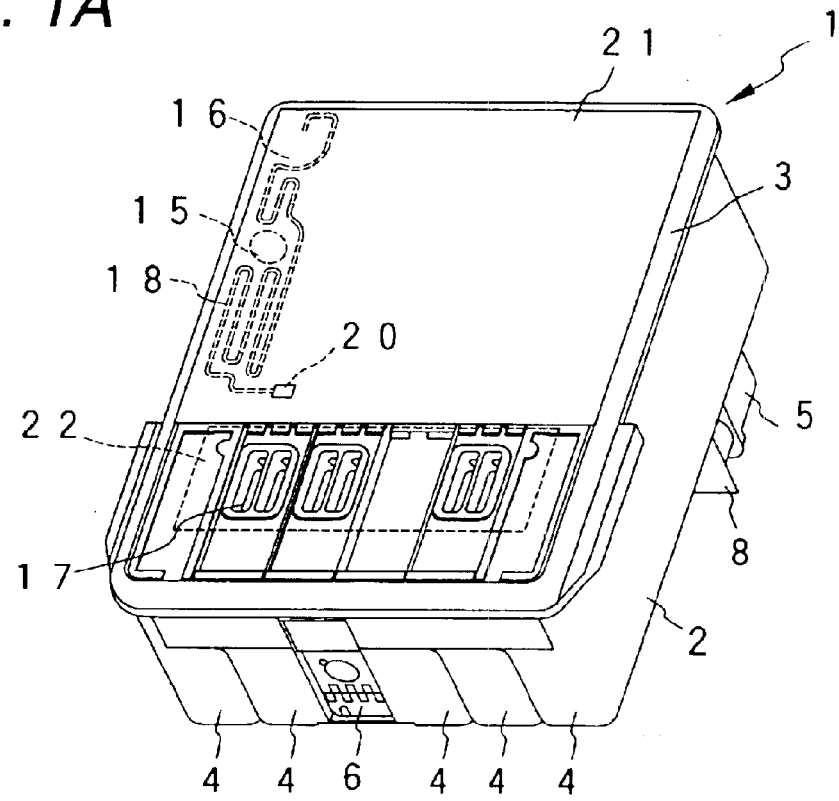
FIGS. 1A and 1B show, in a perspective views, an embodiment of an ink cartridge according to the invention.
Figure 1B:
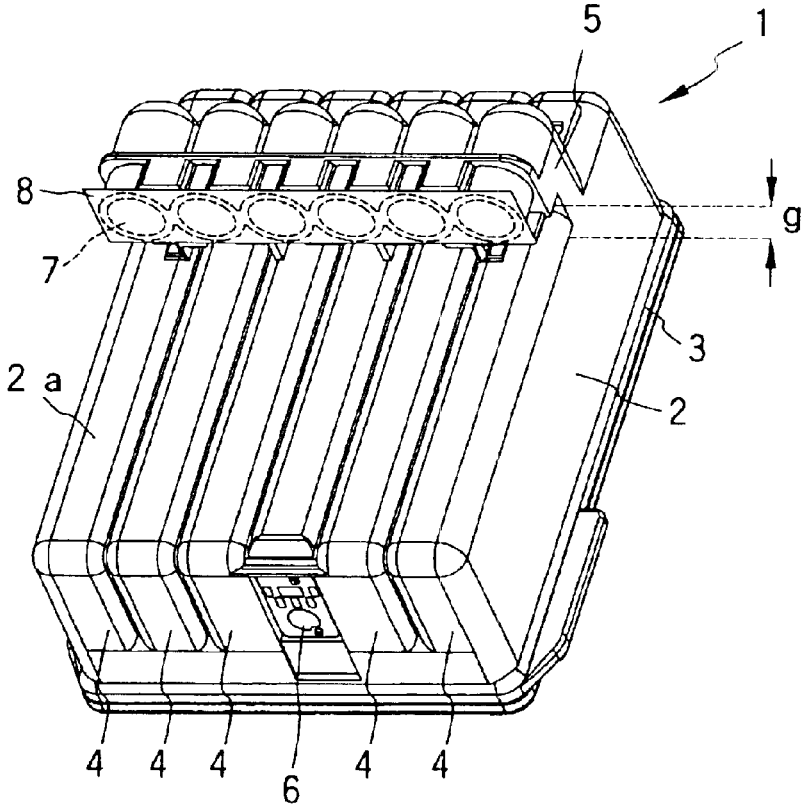

FIG. 1 is a diagram showing an embodiment of an ink cartridge according to the invention. An ink cartridge includes an ink container body 2 containing ink and a lid 3 which is used for sealingly closing an opening of the ink container body. The ink container body 2 is divided into a plurality of ink chambers 4 by a plurality of vertical walls since it contains different kinds of ink. Ink passages 5, shaped like "L", are respectively formed on the locations of the surface of the ink container body, which correspond to the ink chambers, while being disposed parallel to the ink chambers 4.

Figure 2A:
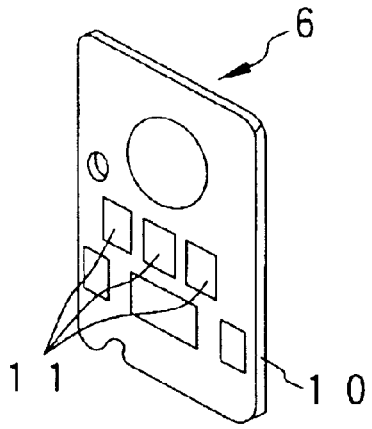
FIGS. 2A and 2B show, in perspective views, the obverse and reverse sides of an embodiment of a storage means to be attached to the ink cartridge.
Figure 2B:
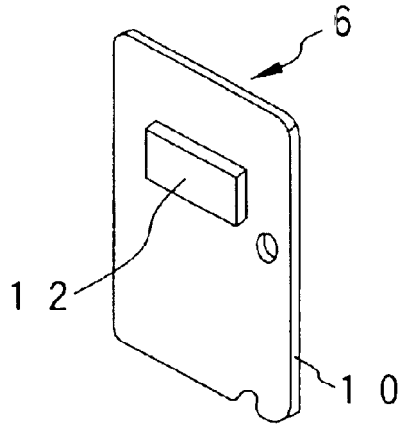

Storage means 6 which stores ink information is mounted on the side wall of the ink container body 2 as its front end as viewed in the inserting direction of the ink container body. The storage means 6, as shown in FIGS. 2(*a*) and 2(*b*), contains a plurality of electrodes 11 and a storage element 12. The electrodes 11 are mounted on the obverse side of a substrate 10, and may be brought into electrical contact with connectors provided on a carriage. The storage element 12 for storing information is mounted on the reverse side of the substrate, and is connected to the electrodes 11.

Ink supply ports 7 which will engage with ink supplying needles are provided at the ends of the ink passages. The ink supply ports are directed perpendicular to a bottom part 2*a* of the ink container body, and spaced from the bottom part 2*a* by a fixed gap "g". The ink supply ports 7 are sealed with an air shielding film 8, which may be pierced with the ink supplying needles.

Figure 3:
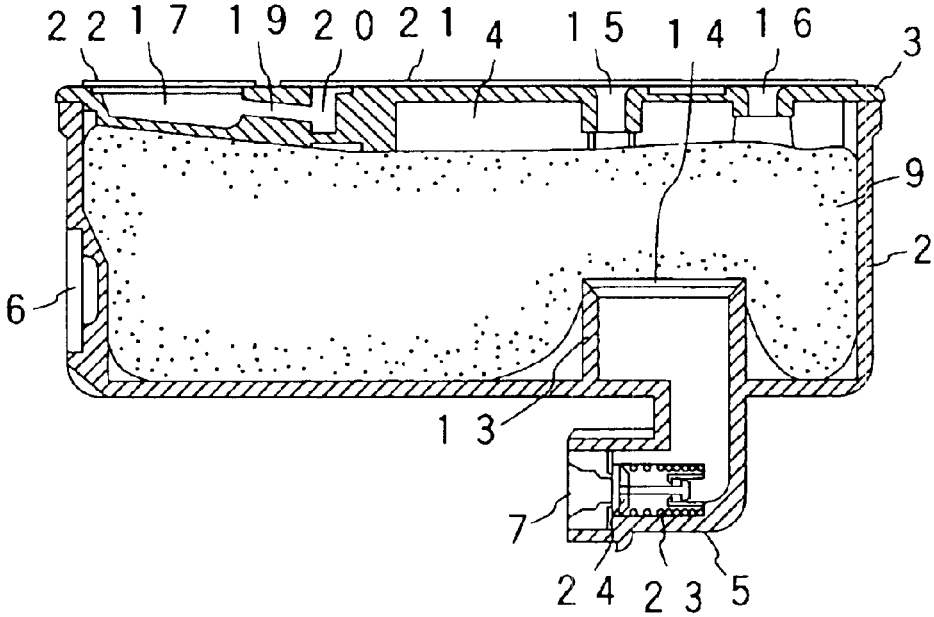
FIG. 3 shows, in a cross sectional view, a structure of the ink cartridge.

The ink cartridge will be described in detail with reference to a cross sectional view shown in FIG. 3.

The ink chambers 4 formed in the ink container body 2 contain porous materials 9 which may be impregnated with ink. An ink inflow port 13, which communicates with the ink passage 5 associated therewith, is formed in each ink chamber, while being projected upward from the bottom surface of the ink chamber. A filter 14 is provided at the upper end of the ink inflow port 13 for removing air bubbles or foreign matters.

The lid 3 includes, correspondingly to the respective ink chambers 4, ink injection holes 15, atmosphere openings 16, recesses 17 forming communicating ports communicating with the atmosphere openings 16, and narrow grooves 18 which connects the atmosphere openings 16 and the recesses 17 and have given fluid resistance values. The recess 17 is connected to an end of the narrow groove 18 through a through hole 19 which extends downward and somewhat inclined and a vertically extending hole 20.

The ink injection holes 15, the atmosphere openings 16, the narrow grooves 18 and the vertical holes 20 are sealed with a film 21 having a gas shielding property. The recess 17 is sealed with a film 22 which has a gas shielding property and is easy to be broken.

In the embodiment, a valve 24 is disposed near each of the ink supply ports. The valve 24 is urged toward the ink supply port by a spring 23, and is opened when the ink supplying needle is inserted thereinto.

Figure 4:
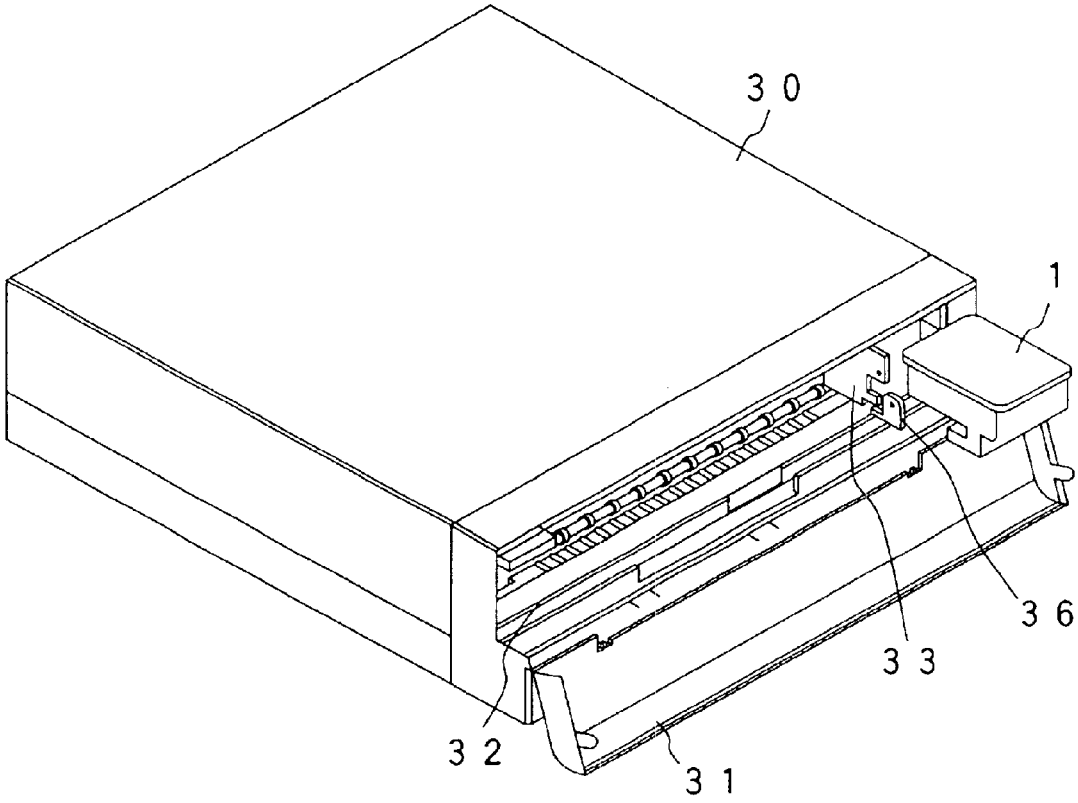
FIG. 4 shows, in a perspective view, an embodiment of an inkjet recording head for which the ink cartridge is well adaptable.

FIG. 4 shows an embodiment of a recording apparatus, which receives ink from the ink cartridge 1 as described above. A box-shaped case 30, which includes a print mechanism, has a case cover 31. The case cover is hinged so as to open and close the upper half of the front surface of the case. Disposed in the area to be opened is a carriage 33 which is reciprocatively and horizontally moved while being guided along and by a guide bar 32.

Figure 5:
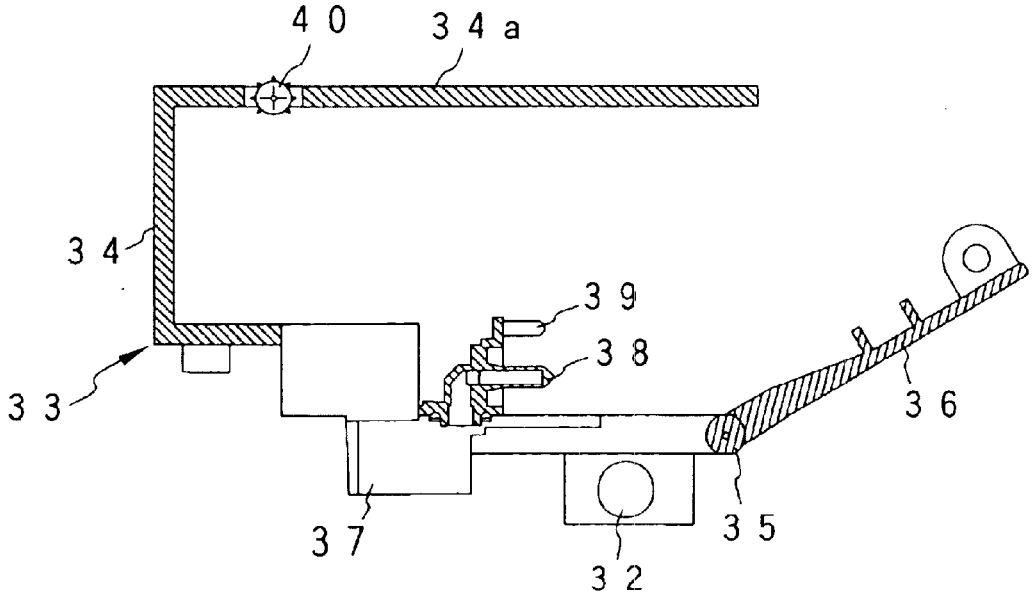
FIG. 5 shows, in a cross sectional view, a structure of a carriage of the ink jet recording head.

The carriage 33, as shown in FIG. 5, includes a main body 34, shaped like a box, which may accommodate the ink cartridge 1 in the horizontal direction, and a cartridge lever 36 which is supported at the lower end by a hinge 35. An ink jet recording head 37 is provided on the lower surface of the carriage.

Ink supplying needles 38 communicating with the ink jet recording head 37, while being horizontally projected, are located at a position opposed to the ink supply ports 7 of the ink cartridge 1 when the ink cartridge is loaded into the carriage. Protrusions 39 are located above the ink supplying needles. The protrusions 39 will advance to between the bottom part 2*a* of the ink cartridge 1 and the ink supply passages 5.

A breaking tool 40 for breaking the film 22 on the recesses 17 prior to a state in which the communication of the ink cartridge 1 with the ink supplying needles 38 is set up is provided on the upper surface 34*a* of the main body 34. In the embodiment, the breaking tool 40 takes the form of a plurality of wheels, each having a plurality of radially extending protrusions.

When the ink cartridge is loaded to the recording apparatus in the embodiment; the carriage 33, as shown in FIG. 4, is moved to a proper position for the replacement of the ink cartridge 1 (to the right end in the embodiment), and the case cover 31 is opened.

The cartridge lever 36 of the carriage 33 as exposed through the opening operation is turned to open the front side of the box-like carriage 33.

Figure 6A:
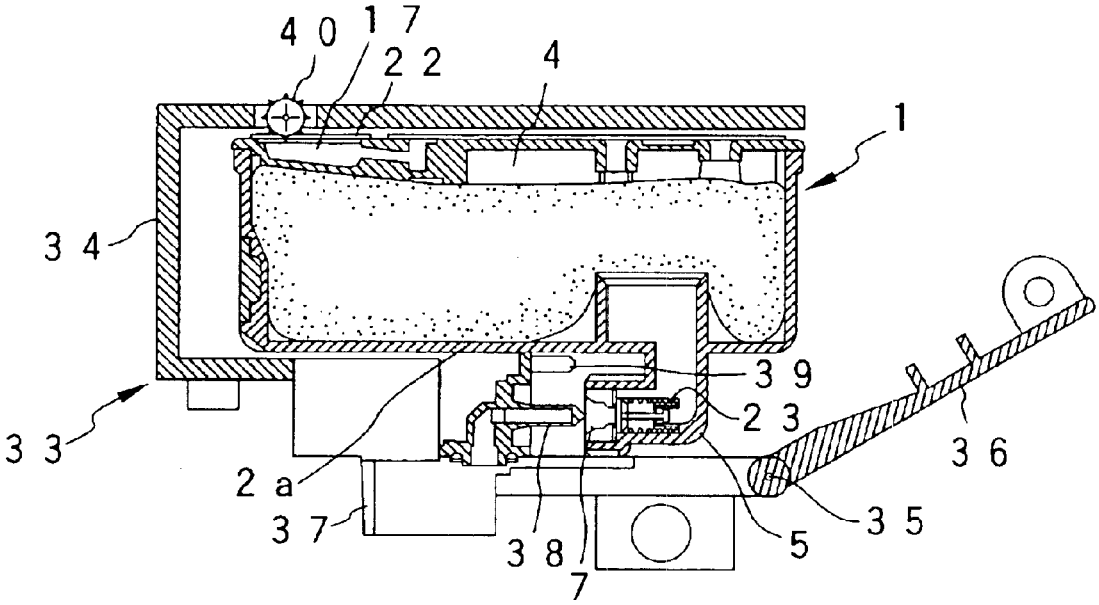
FIGS. 6A and 6B show, in cross sectional views, a state of the ink cartridge that ink chambers are communicated with the atmosphere during the loading operation of the ink cartridge to the carriage, and another state that it is ready for the supply of ink to the recording head.
Figure 6B:
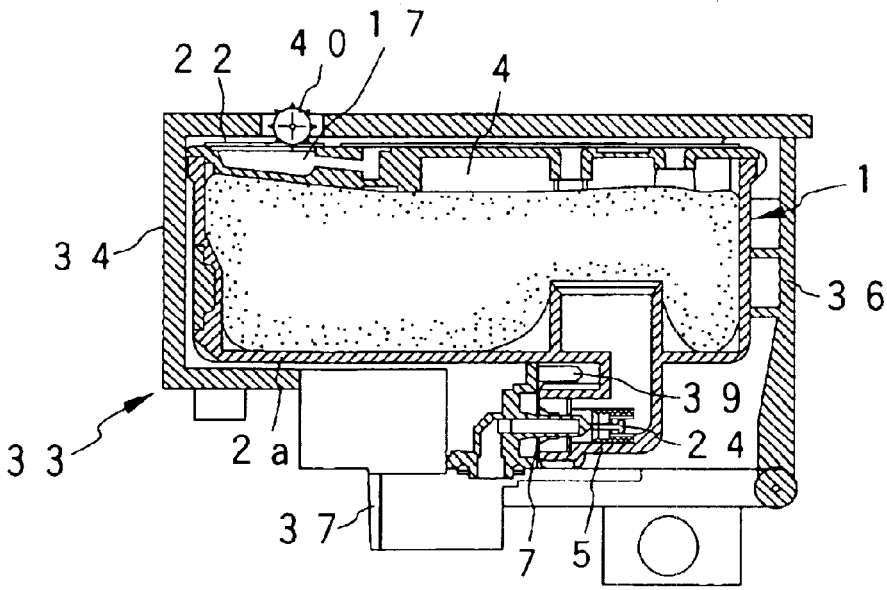

In this state, the user holds the ink cartridge 1 such that the ink supply ports 7 of the cartridge are directed to the inner part of the carriage 33, positions the ink cartridge to the carriage, and pushes it into the carriage horizontally. During the inserting operation, the breaking tool 40 is brought into resilient contact with the film 22, and breaks the film 22, so that the ink chambers 4 are exposed to the air (FIG. 6(*a*)).

The ink cartridge is further pushed to the inner part of the carriage horizontally, and then the ink cartridge 1 is guided by the protrusions 39 having been inserted to between the bottom part 2*a* and the ink supply passages 5, and the ink supplying needles 38 are inserted into the ink supply ports 7. Consequently, each valve 24 retracts, and each ink chamber 4 communicates with the recording head.

Since the ink chamber 4 is opened to the atmosphere before the valve 24 of the ink supply port 7 is opened, it never happens that as the result of the loading of the ink cartridge 1, ink flows backward from the recording head to the carriage.

In a state that the ink cartridge 1 is loaded to the carriage 33, the recording head 37 is located just under the bottom surface of the ink cartridge 1. Accordingly, the area or volume of the carriage is smaller than that of the related ink cartridge in which the ink supply ports are formed in the side wall of the ink cartridge, whereby the size of the recording apparatus is reduced.

When the ink of the ink cartridge is used up, the carriage 33 is moved to a proper position for the replacement of the ink cartridge 1, the case cover 31 is released, and the cartridge lever 36 is turned to open the front surface of the box-like main body 34 (FIG. 4), as in the case of loading the ink cartridge.

In this state, the ink cartridge 1 is horizontally pulled out, the ink supply ports 7 retracts from the ink supplying needles 38 while being guided by the protrusions 39. The valves 24 are urged by the springs 23 to close the ink supply ports 7. Further, the ink cartridge 1 is horizontally moved, and then it is pulled out of the carriage 33.

In this state, the ink as left is retained by the capillary force of the porous material 9. Further, the ink supply ports 7 are sealed with the valves 24. Accordingly, there is no fear that the ink leaks out of the ink chambers 4.

Figure 7A:
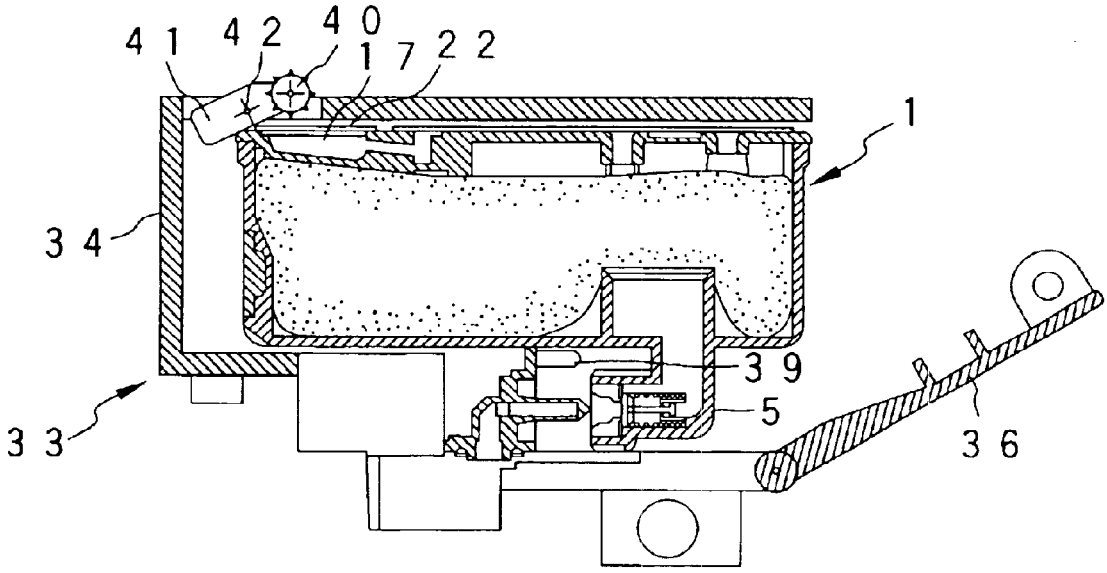
FIGS. 7A and 7B show, in cross sectional views, a state of an ink cartridge of another embodiment of the invention that ink chambers are communicated with the atmosphere during the loading operation of the ink cartridge to the carriage, and another state that it is ready for the supply of ink to the recording head.
Figure 7B:
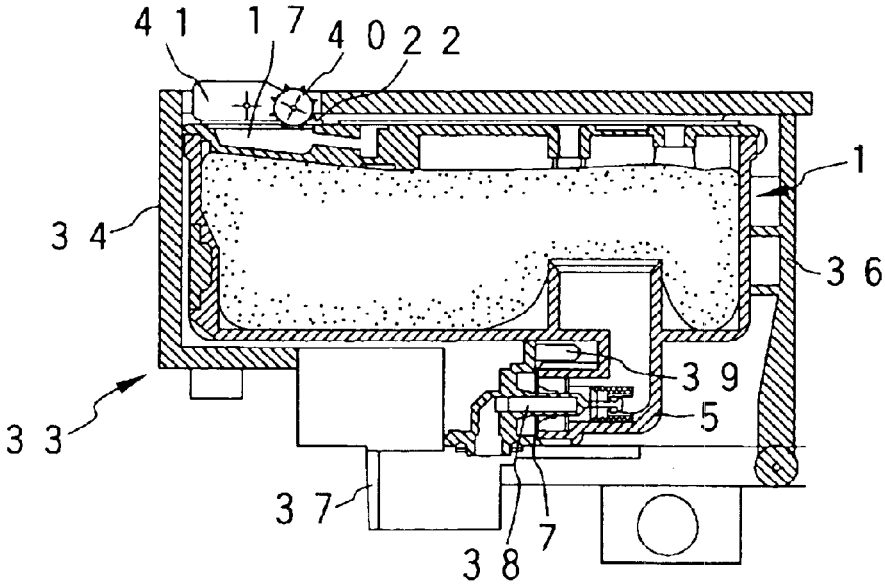

FIGS. 7(*a*) and 7(*b*) show another embodiment of the carriage according to the present invention. A lever 41 is rotatably supported by a shaft 42 in a state that it is urged such that the top (the left end in the drawing) of the lever 41 as viewed in the insertion direction of the ink cartridge 1 is located downward. The breaking tool 40 is mounted at the tip of the lever 41.

In the embodiment, the ink cartridge 1 is loaded into the carriage 33, and horizontally pushed into the latter. Then, the tip of the upper part of the ink cartridge is brought into contact with the rear end of the lever 41 (FIG. 7(*a*)). In this state, the ink cartridge is further pushed thereinto, and then the lever 41 is turned, the breaking tool 40 breaks the film 22, and the ink chambers 4 are opened to the air.

The ink cartridge 1 is further moved into the carriage, and the ink supply ports 7 come into engagement with the ink supplying needles 38 (FIG. 7(*b*)). In this state, ink may be supplied from the ink chambers 4 to the recording head 37.

Figure 8A:
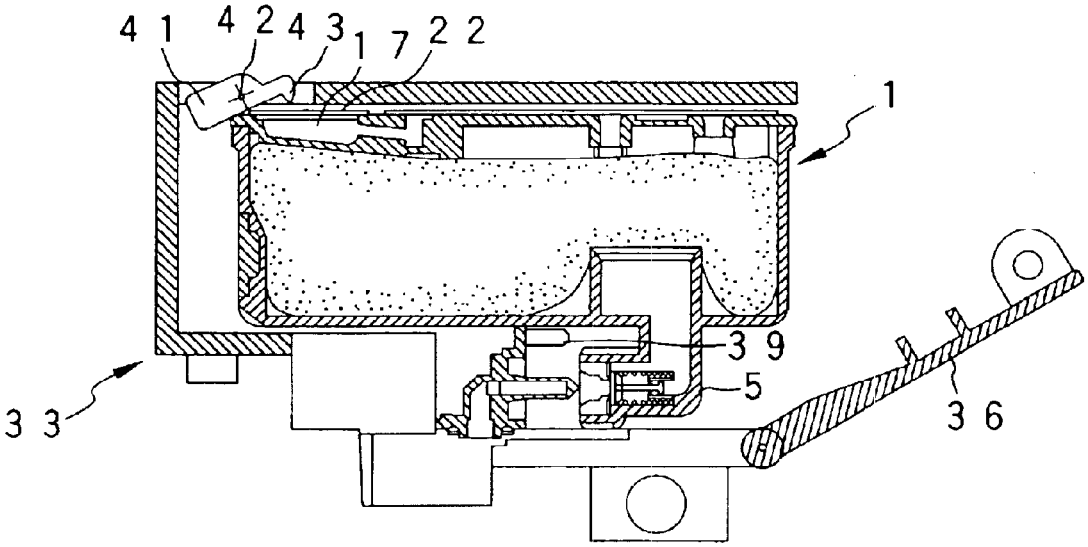
FIGS. 8A and 8B show, in cross sectional views, a state of an ink cartridge of yet another embodiment of the invention that ink chambers are communicated with the atmosphere during the loading operation of the ink cartridge to the carriage, and another state that it is ready for the supply of ink to the recording head.
Figure 8B:
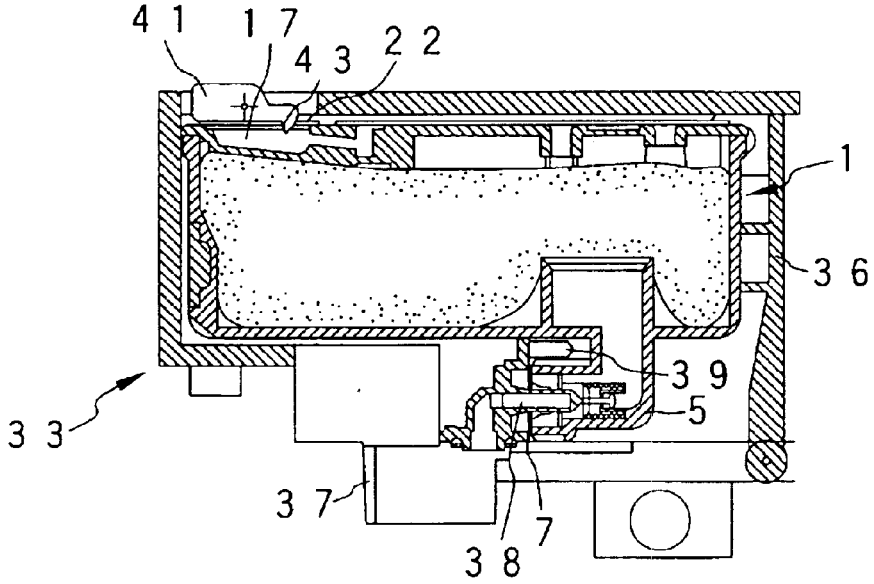

FIGS. 8(*a*) and 8(*b*) show yet another embodiment of the carriage according to the present invention. In the embodiment, a plurality of levers 41 are rotatably supported by a shaft 42 in a state that they are urged such that the top (the left end in the drawing) of each lever 41 as viewed in the insertion direction of the ink cartridge 1 is located downward. A sharpened part 43 is formed at the tip of each lever 41.

In the embodiment, the ink cartridge 1 is loaded into the carriage 33, and horizontally pushed into the latter. Then, the tip of the upper part of the ink cartridge is brought into contact with the rear ends of the levers 41 (FIG. 8(*a*)). In this state, the ink cartridge 1 is further pushed thereinto, and then the levers 4 are turned clockwise, the sharpened parts 43 break the film 22, and the ink chambers 4 are opened to the air.

The ink cartridge 1 is further moved into the carriage, and then the ink supply ports 7 come into engagement with the ink supplying needles 38 (FIG. 8(*b*)). In this state, ink may be supplied from the ink charters 4 to the recording head 37.

Figure 9:
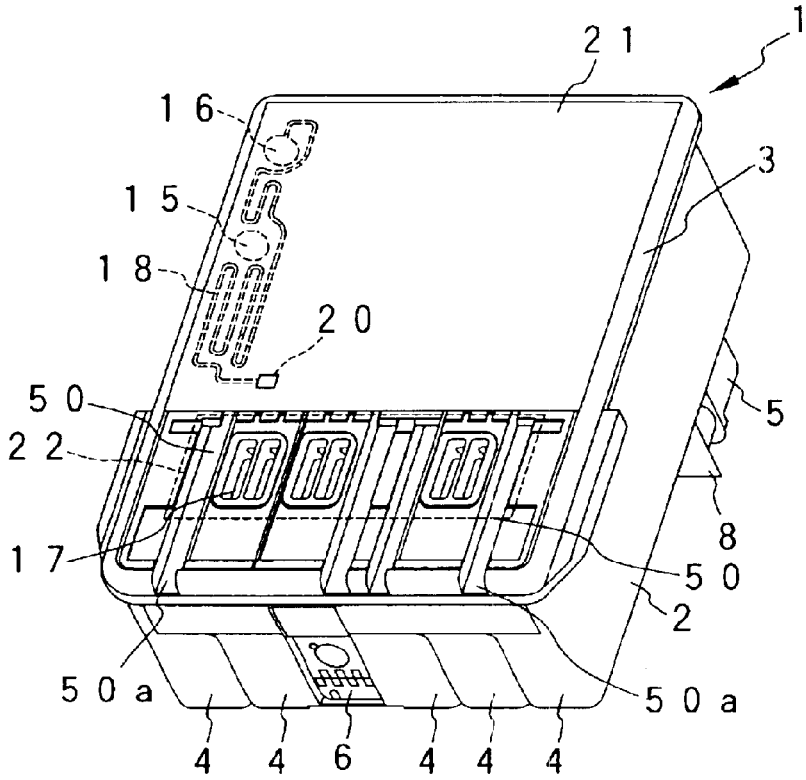
FIG. 9 shows, in a perspective view, another embodiment of an ink cartridge according to the invention.

FIG. 9 shows another embodiment of the ink cartridge according to the present invention. In this embodiment, grooves 50 having openings 50*a* at the fore end as viewed in the insertion direction are formed at positions located apart from the recesses 17 of the lid 3, and a film 22 having a gas shielding property is applied to the recesses 17 and the grooves 50 so as to seal them.

Figure 10:
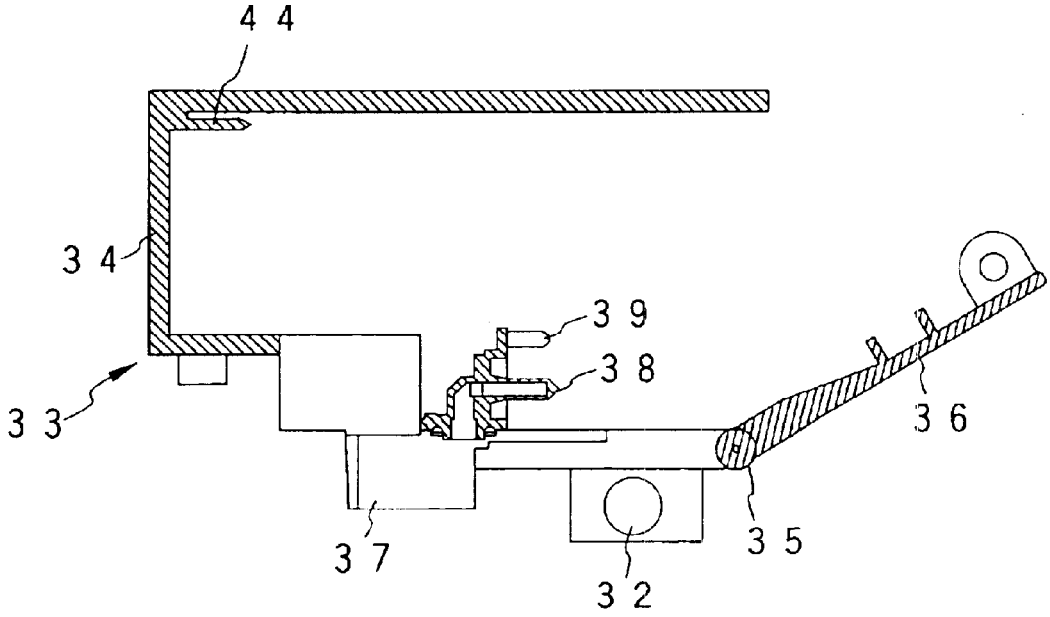
FIG. 10 is a cross sectional view showing a structure of a carriage which is well adaptable for the ink cartridge.

FIG. 10 is a cross sectional view showing a carriage which is well adaptable for the ink cartridge. The carriage 33, as in the embodiment mentioned above, includes a main body 34 shaped like a box, and a cartridge lever 36 which is supported at the lower end by a hinge 35. An ink jet recording head 37 is provided on the lower surface of the carriage.

Ink supplying needles 38 communicating with the ink jet recording head 37, while being horizontally projected, are located at a position opposed to the ink supply ports 7 of the ink cartridge 1 when the ink cartridge is loaded into the carriage. Protrusions 39 are disposed above the needles 38 so as to be insertable between the bottom part 2*a* of the ink cartridge 1 and the ink supply passage 5.

Further, protrusions 44 are disposed on the box-like main body 34 so as to be inserted into the grooves 50 and to roll up the film 22 prior to a state in which the communication of the ink cartridge 1 with the ink supplying needles 38 is set up.

Figure 11A:
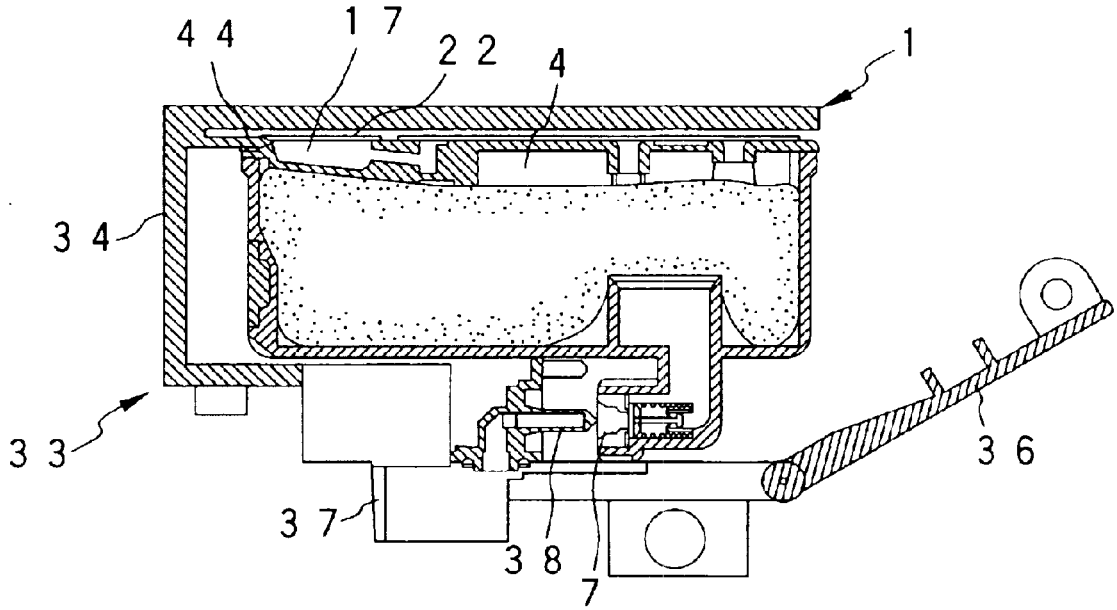
FIGS. 11A and 11B show, in cross sectional views, a state of an ink cartridge of still another embodiment of the invention that ink chambers are communicated with the atmosphere during the loading operation of the ink cartridge to the carriage, and another state that it is ready for the supply of ink to the recording head.
Figure 11B:
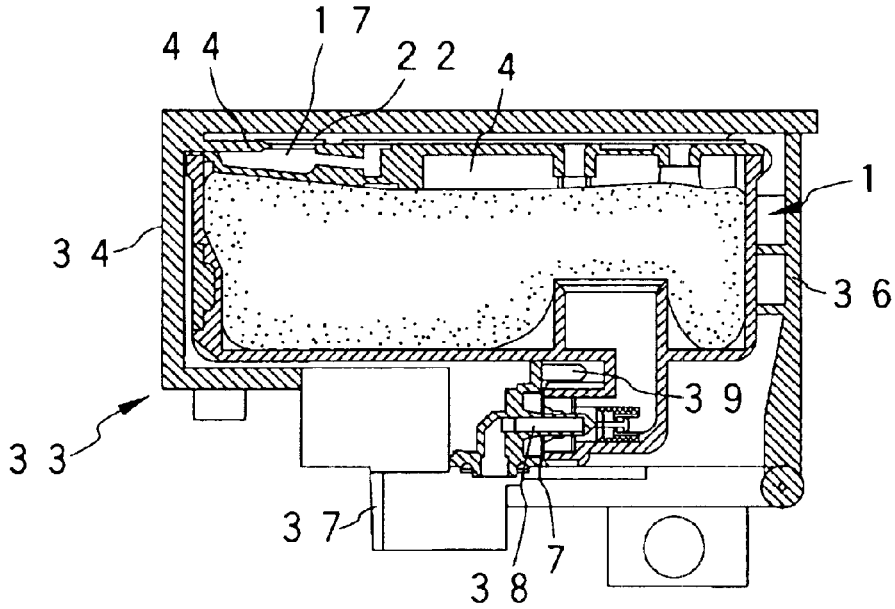

In this embodiment, the cartridge lever 36 of the carriage 33 is turned to open the front side of the box-like main body 34. The user holds the ink cartridge 1 such that the ink supply ports 7 of the cartridge are directed to the inner part of the carriage, positions the ink cartridge to the carriage 33, and pushes it into the carriage horizontally. During the inserting operation, the protrusions 44 advance into the grooves 50 to peel the film 22 from the recesses 17 of the lid 3 and to open the ink chambers 4 to the air (FIG. 11(*a*)).

The ink cartridge is further pushed to the inner part of the carriage horizontally, and then the ink cartridge 1 is guided by the protrusions 39 having been inserted between the bottom part 1*a* and the ink supply passages 5, and the ink supplying needles 38 are inserted into the ink supply ports 7. Consequently, each valve 24 retracts, and each ink chamber 4 communicates with the recording head (FIG. 11(*b*)).

Figure 12:
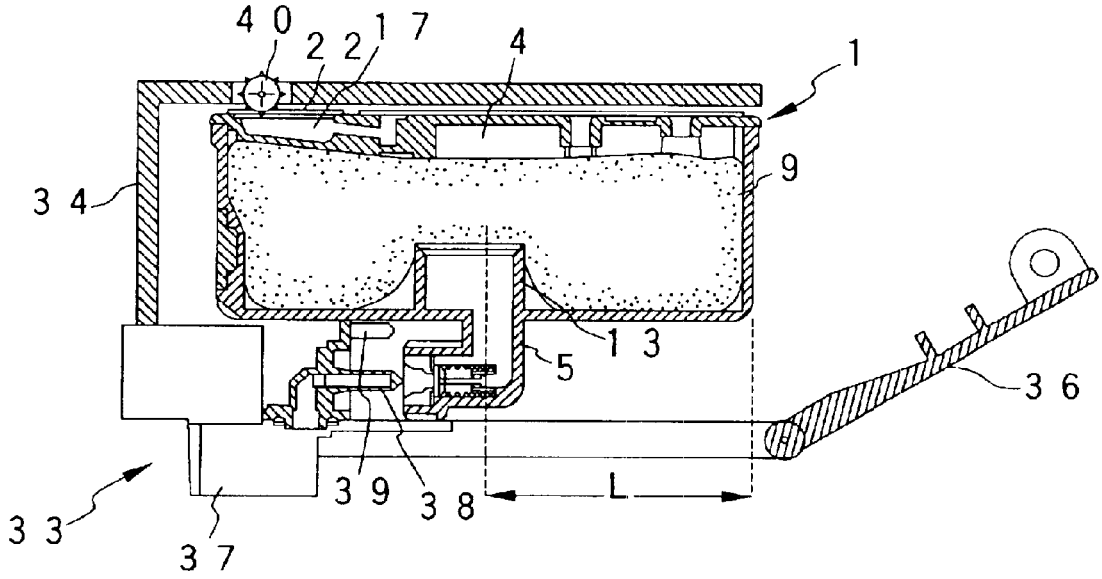
FIG. 12 is a cross sectional view showing a structure containing an ink cartridge and a carriage, which the structure forms another embodiment of the invention.

In the embodiments mentioned above, the ink supply passages 5 are each located somewhat closer to the insertion direction rear end of the ink cartridge. A distance L measured from the wall surface may be adjusted such that the protruded part 13 is located at the central area of the ink chamber 4, and the recording head 37 is located at the bottom surface region of the ink cartridge 1, as shown in FIG. 12. If so done, ink of the porous material 9 may be uniformly supplied to the recording head 37. As a result, the amount of the ink left is reduced as small as possible.

Figure 13:
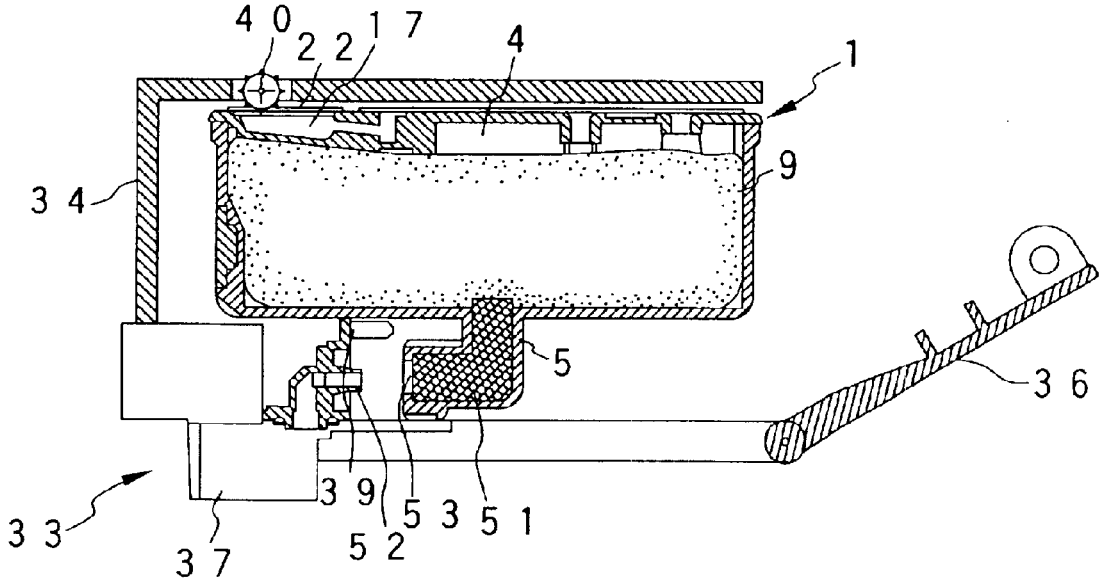
FIG. 13 is a cross sectional view showing a structure containing an ink cartridge and a carriage, which the structure forms yet another embodiment of the invention.
Figure 14:
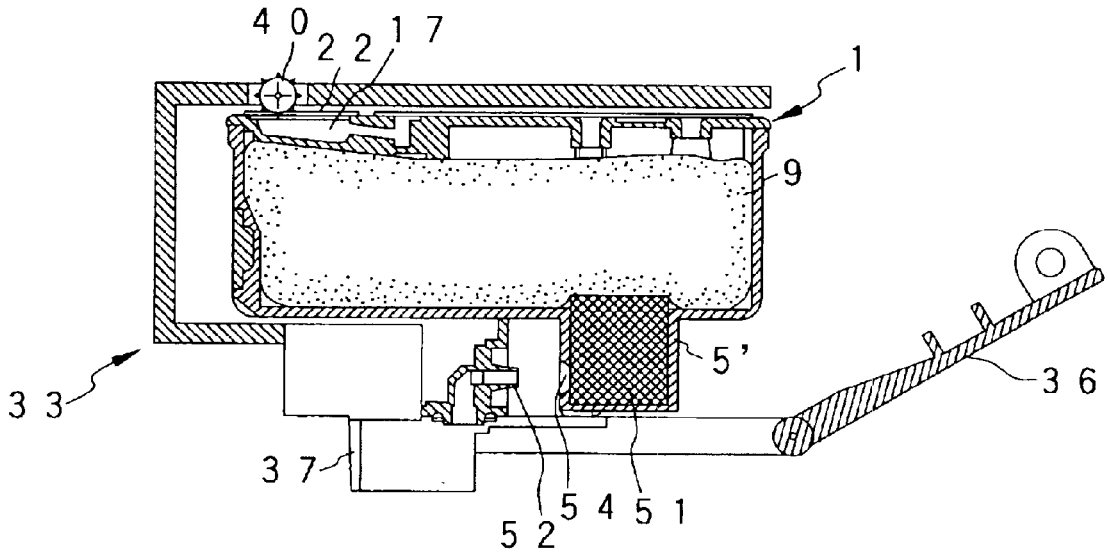
FIG. 14 is a cross sectional view showing a structure containing an ink cartridge and a carriage, which the structure forms still another embodiment of the invention.

In the embodiments mentioned above, the ink cartridge is communicated with the recording head by inserting the ink supplying needles 38. In this connection, an alternative is shown in FIG. 13. In the alternative, a second porous material 51 of which the capillary force is larger than that of the porous material 9 is used. The porous material is put in the ink supply passage 5 in a state that it is in resilient contact with the porous material 9. The structure further includes an opening 53 which is to be in resilient contact with the ink guide pipe 52 communicating with the recording head 37. In the structure using the second porous material 51, an ink supply passage 5' is vertically formed as shown in FIG. 14. An opening 54 is formed at a location facing the ink guide pipe 52.

As seen from the foregoing description, the present invention reduces the length of the ink passage ranging to the recording head, and suppresses the increase of the area or volume of the carriage, and realizes a small recording apparatus of the front loading type. Since the vicinity of the ink passages is guided by the protrusions of the recording apparatus, those are reliably connected to the ink guide members.

What is claimed is:

1. An ink cartridge to be mounted on a moveable carriage, the ink cartridge comprising:

a container having a bottom wall and defining at least one ink chamber;

a protruded portion protruded from the bottom wall and defining an ink supply passage;

an ink supply port, provided at the protruded portion, the ink supply port having an opening wall substantially perpendicular to the bottom wall, the opening wall being located within an area of the bottom wall, and a guide portion located between the bottom wall and the opening wall.

2. The ink cartridge according to claim 1, further comprising:

a normally-closed valve system provided near the ink supply port.

3. The ink cartridge according to claim 1, further comprising:

a recess communicating with the ink chamber and formed in an upper wall of the container; and a breakable film sealing the recess.

4. The ink cartridge according to claim 3, further comprising:

a capillary of a narrow groove formed in the upper wall of the container, wherein the recess communicates with the ink chamber through the capillary.

5. The ink cartridge according to claim 1, wherein the ink supply passage extends substantially parallel to the bottom wall.

6. The ink cartridge according to claim 1, wherein the ink supply passage is disposed at a predetermined distance from the bottom wall and located within an area below the bottom wall.

7. The ink cartridge according to claim 1, wherein the ink supply port is connectable to an ink guide member communicating with a recording head of an ink jet recording apparatus.

8. The ink cartridge according to claim 1, wherein the guide portion is guided by a protrusion of an ink jet recording apparatus when the ink supply port is connected to an ink guide member communicating with a recording head of the ink jet recording apparatus.

9. The ink cartridge according to claim 1, wherein the opening wall is substantially perpendicular to a general ink flow direction through the ink supply port.

10. An ink jet recording apparatus adapted for use with an ink cartridge, comprising:

a reciprocatively movable carriage;

an ink jet recording head provided on a lower wall of the carriage within an accommodation area of the ink cartridge;

an ink guide member through which ink in the ink cartridge being mounted on the carriage is supplied to the ink jet recording head, the ink guide member having a horizontally protruded leading end; and a protrusion provided on the carriage, wherein the protrusion horizontally protrudes near the ink guide member, for engagement of the ink cartridge and the carriage.

11. An ink jet recording apparatus adapted for use with an ink cartridge, comprising:

a reciprocatively movable carriage;

an ink jet recording head provided on a lower wall of the carriage within an accommodation area of the ink cartridge;

an ink guide member through which ink in the ink cartridge being mounted on the carriage is supplied to the ink jet recording head, the ink guide member having a horizontally protruded leading end;

a protrusion, horizontally protruded near the ink guide member, for engagement with the ink cartridge; and a breaking system for breaking a film which sealingly covers an atmosphere communicating recess formed in an upper wall of the ink cartridge.

12. The recording apparatus according to claim 11, wherein the breaking system breaks the film before the ink guide member engages the ink cartridge to allow ink to be supplied to the ink jet recording head.

* * * * *